US009857152B2

(12) United States Patent
Franco, Sr.

(10) Patent No.: US 9,857,152 B2
(45) Date of Patent: Jan. 2, 2018

(54) AUTO-LOCK BROADHEAD

(71) Applicant: Roger Dennis Franco, Sr., Raymond, NH (US)

(72) Inventor: Roger Dennis Franco, Sr., Raymond, NH (US)

( * ) Notice: Subject to any disclaimer, the term of this patent is extended or adjusted under 35 U.S.C. 154(b) by 0 days.

(21) Appl. No.: 14/146,366

(22) Filed: Jan. 2, 2014

(65) Prior Publication Data

US 2015/0184986 A1 Jul. 2, 2015

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,579,348 | A * | 4/1986 | Jones | 473/583 |
| 5,564,713 | A * | 10/1996 | Mizek et al. | 473/583 |
| 5,803,844 | A * | 9/1998 | Anderson | 473/583 |
| 6,910,979 | B2 * | 6/2005 | Barrie et al. | 473/583 |
| 7,713,152 | B1 * | 5/2010 | Tentler et al. | 473/583 |

* cited by examiner

*Primary Examiner* — John Ricci
(74) *Attorney, Agent, or Firm* — Hayes Soloway PC

(57) ABSTRACT

An Auto-Lock Broadhead is disclosed having incorporated a unique, new, fail-safe, self-locking system to eliminate the possibility of blade failure, either upon launching, or upon impact. It is the only current design of its kind in existence.

14 Claims, 6 Drawing Sheets

AUTO-LOCK BROADHEAD

BACKGROUND

An Auto-Lock broadhead is a mechanical arrow head. This device when affixed to an arrow, which is launched from an archery hunting bow, is designed for the purpose of harvesting game animals. The difference between fixed blade broadheads and mechanical broadheads, is that fixed blades are just that. They are constructed with blades that do not move or open.

Mechanical broadheads are designed to flip open their blades to create a much larger wound channel than fixed blades to facilitate a cleaner, quicker dispatching of the prey animal.

All mechanical broadheads are supposed to remain closed during launching, to obtain maximum aerodynamic flight, and open to their full cutting potential upon impact. The Auto-Lock broadhead is unique in its design, in that it is the only broadhead that has a fail-safe, self-locking mechanism, which locks it closed on launching and locks it opened on impact.

The Auto-Lock broadhead is a completely new design regarding mechanical broadheads. The unique self-locking design features enable it to eliminate the current failure rate problems plaguing the mechanical broadhead industry. Specifics of the self-locking system are described in detail in the description section.

BRIEF SUMMARY OF INVENTION

Current mechanical broadhead designs do not have a positive reliability factor. Additionally, current mechanical broadhead designs have a tendency to open in flight, causing erratic arrow flight, have a tendency to allow the blades to collapse on impact, and have no positive locking system to insure reliability. Additionally, current mechanical broadhead designs rely totally on the forward inertia of the arrow to maintain full deployment of the blades and a majority use an un-reliable rubber band to keep them closed during launching.

The presently disclosed Auto-Lock broadhead has increased the reliability factor exponentially by: (a) including a blade with a locking notch that positively enables the blades to lock open; (b) providing a ferrule pin for the blade notches to lock onto, once fully deployed; and (c) incorporating a coil spring that keeps the intrinsically designed notches in the front of the blade forced forward, inside the ferrule, during launching, to eliminate the possibility of the blades prematurely opening during launching.

An objective of the disclosed Auto-Lock broadhead is to improve the performance, or non-performance of the mechanical broadheads currently available.

BRIEF DESCRIPTION OF THE DRAWINGS

FIGS. 1A and 1B each include an illustration of the positioning of a blade 7 inside ferrule 4. As can be seen in FIG. 1A, blades 7 are held in the forward closed position by the coil spring 3 with the forward notch 8 in the blades locked inside the ferrule 4. As can be seen in FIG. 1B, blades 7 are locked in the fully deployed, open position by the notches 8 in the underside of the blades resting on the pin 10 in the ferrule 4.

FIGS. 2A and 2B show side views of the exemplary blade 7 and FIG. 2C shows an end view of the blade 7, with height and thickness illustrated.

FIGS. 3A and 3B show side views of an exemplary aluminum ferrule 4, herein sometimes referred to as a "housing," which the other components of the broadhead will be affixed to.

As shown in FIGS. 1A and 1B, threaded tip 6 may screw onto the leading end of the piston 2 to provide penetration.

DETAILED DESCRIPTION OF INVENTION

Figure 1A:
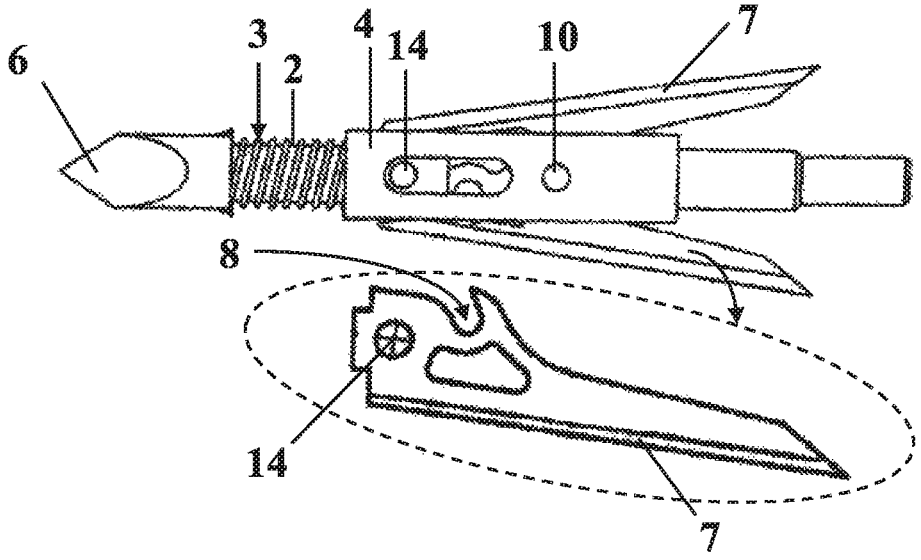
FIG. 1A shows a side view of an embodiment of the disclosed Auto-Lock in its locked closed state.
Figure 1B:
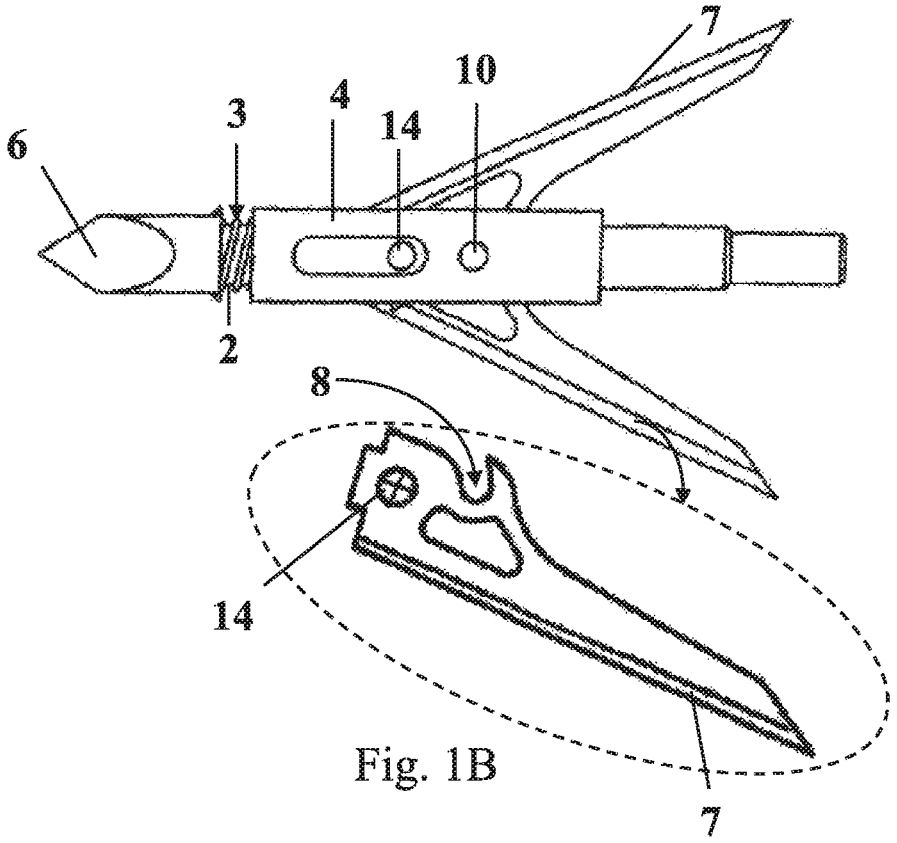
FIG. 1B shows a side view of an embodiment of the disclosed Auto-Lock in its locked opened state.

The Auto-Lock Broadhead's unique design features have eliminated that part of the equation that refers to the failure rate of other mechanical broadheads.

LOCKING THE BLADES OPENED: The blades 7, which are attached to the piston 2 and tip 6, are forced rearward to the fully opened position, by the inertia of the piston 2 being forced rearward, upon impact. The blades 7 are designed with a curved inner surface, which acts as a cam, causing them to open fully, and simultaneously. The blades 7 lock onto a pin 10 installed into the ferrule 4 or main body of the broadhead, when fully deployed. This function prevents them from moving forward and thus having the ability to close or fail to remain opened. (This is a major flaw in all other mechanical broadheads, the ability to remain locked opened)

LOCKING THE BLADES CLOSED: Specially designed notches 8 in the front of the blades 7 lock inside of the aluminum body or ferrule 4. This is accomplished by the spring tension of 0.09 lbs., which surrounds the piston 2, forcing it and the blades 7 forward into the locked closed position. This locking closed function precludes any possibility of the blades 7 opening prematurely during lunching of the arrow, which would cause the arrow to have erratic flight. (Another major flaw in most other mechanical broadheads, as the majority of them rely on a rubber band to keep them closed.) In contrast to other known devices, the disclosed Auto-Lock Broadhead locks in both closed and opened positions. No other current broadhead design incorporates a self-locking system of any kind.

Figure 3A:
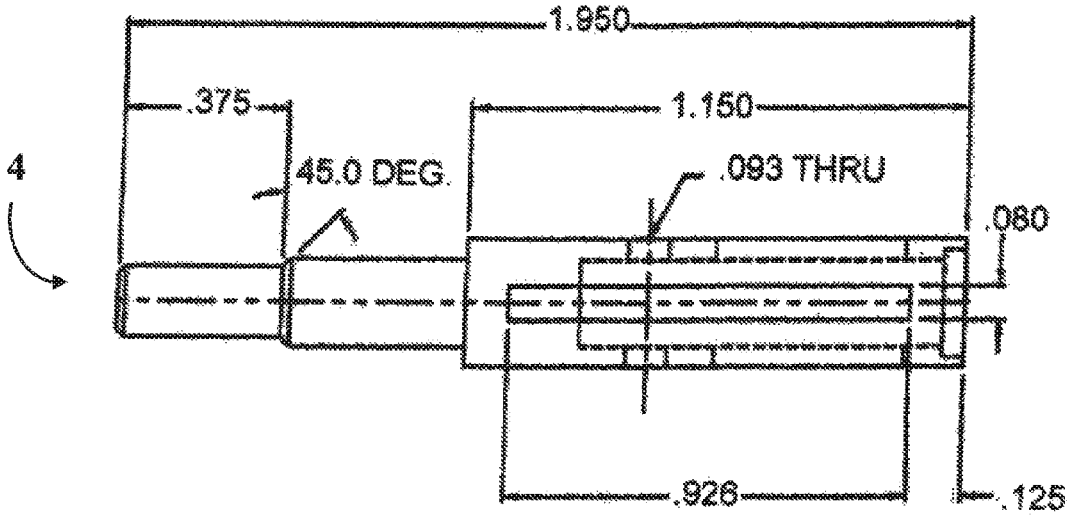
Figure 3B:
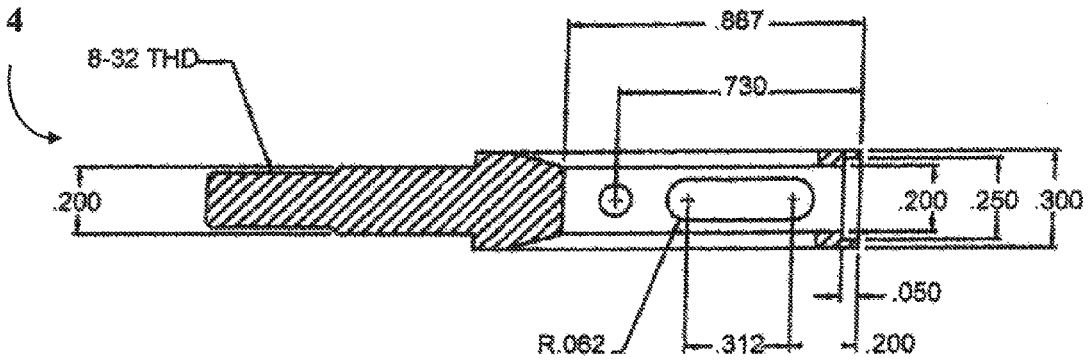
Figure 4A:
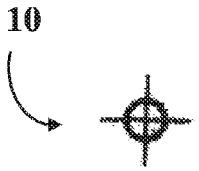
FIG. 4A shows a top view of an exemplary dowel pin 10 and 4B shows a side view of the exemplary dowel pin 10 shown in FIG. 4A. As can be seen in FIGS. 1A and 1B, a dowel pin 10 may be driven into the ferrule 4, upon which the blades 7 lock onto, which locks them in the open position.
Figure 4B:
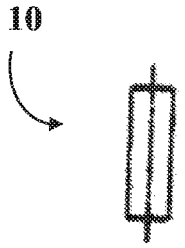
Figure 5A:
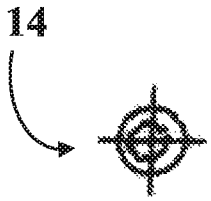
FIG. 5A shows a top view of an exemplary hex socket screw 14 and FIG. 5B shows a side view of the exemplary hex socket screw 14 shown in FIG. 5A. As can be seen in FIGS. 1A and 1B, hex socket screw 14 may attached blades 7 to the piston 2.
Figure 5B:
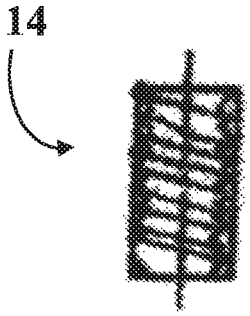
Figure 6A:
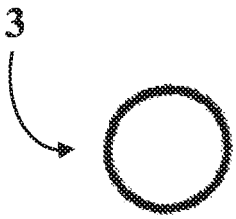
FIG. 6A shows a top view of an exemplary stainless steel spring 3 and FIG. 6B shows a side view of the exemplary stainless steel spring 3 shown in FIG. 6A. As can be seen in FIGS. 1A and 1B, stainless steel spring 3 surrounds the piston 2 to cause forward pressure to lock the blades 7 closed inside the ferrule 4 while in flight.
Figure 6B:
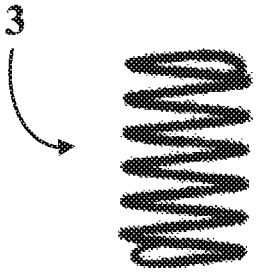

An exemplary listing of Components, Materials, and Dimensions that may be used to produce Auto-Lock Broadheads in accordance with the subject disclosure are as follows:

One Aluminum body (ferrule): machined from—7075-T6 Aluminum, 0.300" in diameter, 1.950" in length. An exemplary aluminum ferrule 4 is illustrated in FIGS. 3A and 3B, along with possible dimensions.

Figure 8:
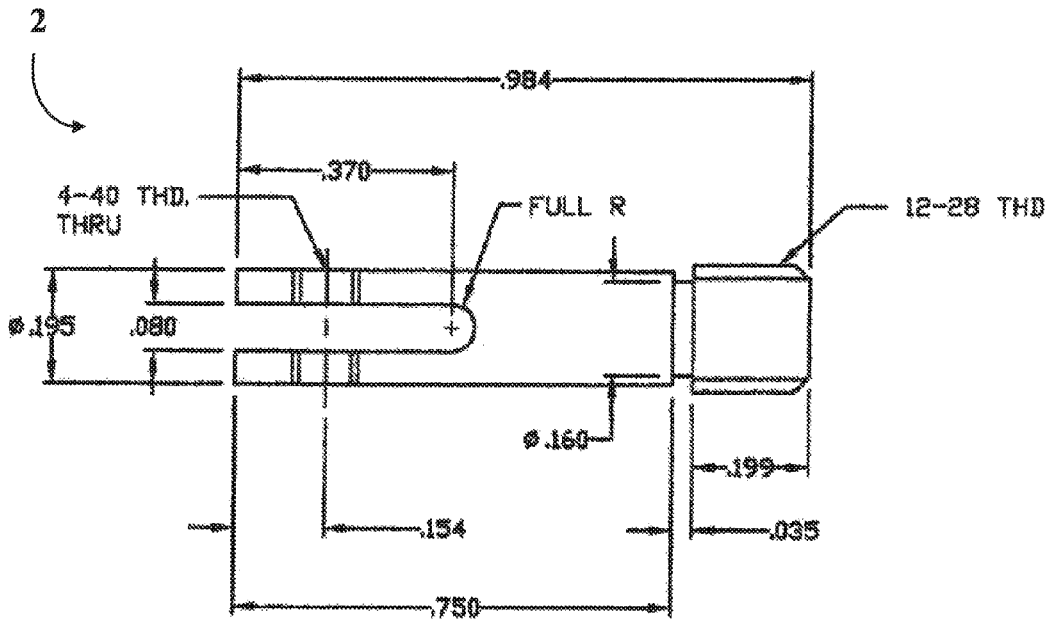
FIG. 8 shows a side view of an exemplary piston 2, to which both blades 7 affix and to which the hardened steel tip 6 is screwed onto.

One Sliding shaft, (piston), machined from: 7075-T6 Aluminum, 0.195" in diameter, overall length is 0.984". An exemplary piston 2 is shown in FIG. 8.

Figure 2A:
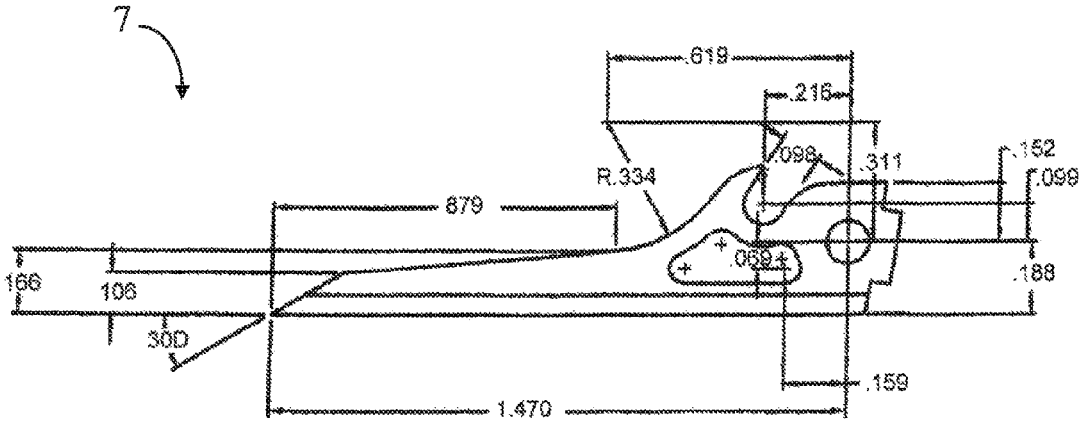
FIG. 2A-2C illustrate an exemplary blade 7 having curved inner surfaces that produce the cam action required to open the blades, a locking notch which interlocks with the ferrule pin to lock them open, and two small notches in the front of the blade which slide under the ferrule to lock them closed.
Figure 2B:
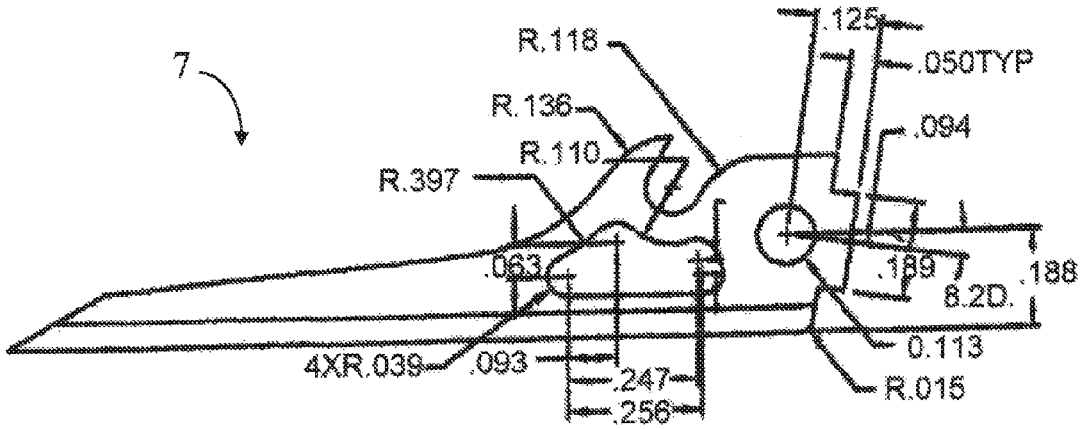
Figure 2C:
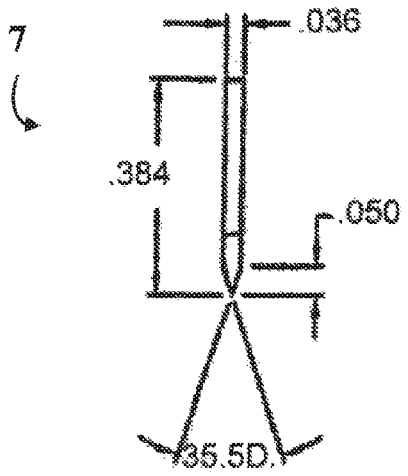

Two Cutting Blades, stamped from, material: 420 stainless steel (0.036) thickness, length is 1.595", each being identical to the other. An exemplary cutting blade 7 is illustrated in FIGS. 2A-2C.

Figure 7A:
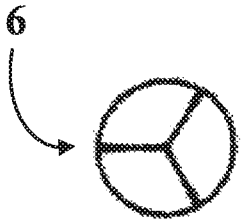
FIG. 7A shows a top view of an exemplary hardened steel, threaded tip 6
Figure 7B:
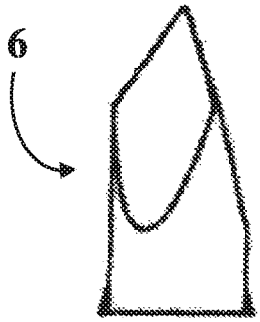
FIG. 7B shows a side view of the exemplary hardened steel, threaded tip 6 shown in FIG. 7A.

One hardened steel, screw on tip, which is threaded onto the leading end of the piston, is machined from 316 steel, hardened to 54C Rockwell. The outside diameter is 0.300". The total length is 0.690". The internal thread is 12×28. An example tip 6 is illustrated in FIGS. 7A-7B.

An Example Manufacturing Processes for the Auto-Lock Broadhead is as Follows.

The aluminum parts, (ferrule and piston) are mass produced on a Swiss type, multi spindle, automatic feed, CNC controlled, turret lathe. They are machined from 7075 grade aluminum round stock. They are then anodized to produce a black color and add hardening to the ferule and piston.

The blades are produced by the stamped metal process. The raw material is 420 annealed stainless steel sheet which is die stamped into their finished shape. The blades are then precipitation hardened and then sharpened. The finish color is natural.

The remaining parts are shelf items obtained from various hardware manufacturers.

Total weight of assembled unit: 100 grains, Total deployed cutting surface 1.8".

What is claimed is:

1. An expandable archery broadhead comprising:

a ferrule having:

a forward passage;

an open interior at a forward end, defined by a side wall, and having a rearward feature for attaching to an arrow, the side wall having opposing blade slots, each blade slot defined by a forward edge and a rearward edge, the side wall also having opposing pin slots which accommodate a blade pivot pin; and a blade-locking pin fixed through the ferrule interior, two opposing blades, each having:

a blade aperture for receiving the blade pivot pin;

an outward cutting edge;

an inward cam edge;

a forward locking edge having a center protrusion defined by opposing cut-outs, the forward edge having a length greater than a diameter of the forward passage, such that the cut-outs can be seated upon forward edges of the blade slots; and a locking-notch positioned along the cam edge, rearward of the locking-edge; and a piston having:

a forward penetrating tip;

a blade slot for receiving the blades;

a piston aperture for receiving the blade pivot pin, to pivotally secure the blades to the piston, the blade pivot pin extending into the ferrule pin slots to slidably retain the piston and blades within the ferrule; and a spring which biases the piston and blades forward relative to the ferrule, wherein prior to shooting, the blades are pivoted inward, and the spring pushes the piston and blades forward, so the cut-outs seat on the blade-slots, and lock the blades from pivoting, and when the piston tip hits a target, the piston is pushed rearward and the blade cam-edges contact the blade-locking pin, which pivots the blades outward, as pressure of target material pushes the blades inward, which brings the blade locking-notches into engagement with the blade-locking pin, which locks the blades outward.

2. The broadhead of claim 1, wherein the blade pivot pin is a retaining set screw.

3. The broadhead of claim 1, wherein the spring is a stainless steel spring which is affixed around the circumference of the piston and is in place between the penetration tip and the ferrule.

4. The broadhead of claim 3, wherein the ferrule includes a receptor groove machined into the leading circumferential edge of the ferrule to retain the spring.

5. The broadhead of claim 3, wherein the broadhead has a stainless steel penetration tip with an 0.050 inch flare at its rear portion to retain the spring.

6. The broadhead of claim 5, wherein the penetration tip includes a three sided penetration point with each point converging at 120 degrees equally.

7. The broadhead of claim 1, wherein the broadhead is threaded at the rear extremity of the ferrule to enable affixing it to an arrow shaft.

8. An expandable archery broadhead comprising:

a ferrule having an interior, a side wall with blade slots, and a blade-locking pin fixed through the interior;

at least two blades, each blade having an outward cutting edge, an inward cam edge, and a locking-notch positioned on the cam edge;

a piston having a tip and slidably mounted on the ferrule; and a retention element connected to the ferrule, the retention element restricting movement of the piston to maintain the blades in an inward position and configured to permit rearward movement of the piston when a significant force is applied to the piston tip, wherein the blade cam-edges contact the blade-locking pin, thereby pivoting the blades outward and the blades become locked in an outward position when the locking-notches engage with the blade-locking pin.

9. The broadhead of claim 8, wherein a force of approximately 0.9 lbs. applied to the piston tip is sufficient to overcome the biasing element and move the blades from the inward position to the outward position.

10. The broadhead of claim 8, wherein the broadhead includes two blades.

11. The broadhead of claim 8 further comprising a blade pivot pin mounted on the ferrule to pivotally secure the blades to the ferrule.

12. The broadhead of claim 8, wherein the piston tip is formed of stainless steel and includes a flare at its rear portion to retain the retention element.

13. The broadhead of claim 8, wherein the retention element is a spring.

14. An expandable archery broadhead comprising:

a ferrule defined by a side wall and having a rearward feature for attaching to an arrow, the side wall having opposing blade slots, each blade slot defined by a forward edge and a rearward edge, the side wall also having opposing pin slots which accommodate a blade pivot pin;

a blade-locking pin fixed through the ferrule, two opposing blades having:

an inward cam edge;

a forward locking edge having a center protrusion defined by opposing cut-outs, wherein the cut-outs are seated upon forward edges of the blade slots; and a locking-notch positioned along the cam edge, rearward of the locking-edge;

a piston pivotally secured to the blades by the blade pivot pin, the blade pivot pin extending into the ferrule pin slots thereby slidably retaining the piston and blades within the ferrule, wherein when the ferrule hits a target, the piston is pushed rearward and the blade cam edges contact the blade-locking pin, which pivots the blades outward, as pressure of target material pushes the blades inward, which brings the blade locking-notches into engagement with the blade-locking pin, which locks the blades outward.

* * * * *